US011657675B2

(12) United States Patent
Lloyd

(10) Patent No.: US 11,657,675 B2
(45) Date of Patent: May 23, 2023

(54) CASINO APPARATUS

(71) Applicant: TCS John Huxley Europe Limited, Stoke-on-Trent (GB)

(72) Inventor: Mark Anthony Lloyd, London (GB)

(73) Assignee: TCS John Huxley Europe Limited, Stoke-On-Trent (GB)

( * ) Notice: Subject to any disclaimer, the term of this patent is extended or adjusted under 35 U.S.C. 154(b) by 0 days.

(21) Appl. No.: 17/253,060

(22) PCT Filed: Jul. 3, 2019

(86) PCT No.: PCT/GB2019/051881

§ 371 (c)(1),
(2) Date: Dec. 16, 2020

(87) PCT Pub. No.: WO2020/008190

PCT Pub. Date: Jan. 9, 2020

(65) Prior Publication Data

US 2021/0256804 A1 Aug. 19, 2021

(30) Foreign Application Priority Data

Jul. 3, 2018 (GB) ..... 1810911

(51) Int. Cl.
*G07F 17/32* (2006.01)

(52) U.S. Cl.
CPC ..... *G07F 17/3241* (2013.01); *G07F 17/322* (2013.01)

(58) Field of Classification Search
CPC ..... G07F 17/3241; G07F 17/322
See application file for complete search history.

(56) References Cited

U.S. PATENT DOCUMENTS 5,605,334 A * 2/1997 McCrea, Jr. ..... G07F 17/3293 273/309
6,289,261 B1 9/2001 Heidel et al.
(Continued)

FOREIGN PATENT DOCUMENTS

CA 2989878 A1 6/2018
EP 1080348 B1 8/2002
(Continued)

OTHER PUBLICATIONS

International Preliminary Report on Patentability from International Application No. PCT/GB2019/051881, dated Jan. 5, 2021, 6 pp.
(Continued)

*Primary Examiner* — Jasson H Yoo
(74) *Attorney, Agent, or Firm* — Shumaker & Sieffert, P.A.

(57) ABSTRACT

A secure casino apparatus is provided having improved security against theft and/or tampering. The secure casino apparatus comprises, a casing and a cavity within the casing, the casing comprising an access member arranged to provide access to said cavity; a sensor arranged to detect said access to the cavity and provide an access signal; an image capture apparatus arranged to provide image data of the cavity when the image capture apparatus is activated; a memory arranged to store the image data; and a processor arranged to process the image data and the access signal; wherein the processor is further arranged to activate the image capture apparatus for an activation period when an access signal is provided by the sensor. The secure casino apparatus aims to permit remote monitoring within a cavity of the casino apparatus to identify theft or tampering with the apparatus.

24 Claims, 4 Drawing Sheets

(56) References Cited

U.S. PATENT DOCUMENTS

| | | | | |
|---|---|---|---|---|
| 6,293,867 | B1 | 9/2001 | Heidel et al. | |
| 7,677,565 | B2 | 3/2010 | Grauzer et al. | |
| 10,580,068 | B2 * | 3/2020 | Jacobson | G06Q 40/02 |
| 2010/0075490 | A1 | 3/2010 | Li | |
| 2010/0255902 | A1 | 10/2010 | Goldstein et al. | |
| 2013/0137509 | A1 * | 5/2013 | Weber | G07F 17/3202 463/29 |
| 2016/0374494 | A1 | 12/2016 | Geng | |
| 2018/0185741 | A1 | 7/2018 | Shigeta | |
| 2019/0005768 | A1 * | 1/2019 | Wilkinson | G06V 20/66 |
| 2019/0130689 | A1 * | 5/2019 | Baumgarte | G07C 9/00571 |

FOREIGN PATENT DOCUMENTS

| | | | |
|---|---|---|---|
| EP | 1062010 | B1 | 10/2009 |
| EP | 2821976 | A1 | 1/2015 |
| JP | 2005073936 | A * | 3/2005 |
| JP | 2005073936 | A | 3/2005 |
| JP | 2009106474 | A | 5/2009 |
| JP | 2017191356 | A | 10/2017 |
| WO | 2005029229 | A2 | 3/2005 |

OTHER PUBLICATIONS

International Search Report and Written Opinion dated Oct. 9, 2019 from counterpart international application No. PCT/GB2019/051881, 12 pp.

Notice of Intent to Grant and Text Intended to Grant from counterpart European Application No. 1810911 6 dated Nov. 14, 2022, 2 pp. (Attorney Docket No. 1232-041GB01).

Response to examination report issued under Section 18(3) dated Mar. 18, 2022, from counterpart United Kingdom Patent Application No. 1810911.6, filed Aug. 16, 2022, 12 pp.

Response to examination report issued under Section 18(3) dated Sep. 6, 2022, from counterpart United Kingdom Patent Application No. 1810911.6, filed Novembers, 2022,12 pp.

Search Report from counterpart Great Britain Application No. 1810911.6, dated Dec. 18, 2018, 3 pp.

* cited by examiner

CASINO APPARATUS

This application is a national stage application under 35 U.S.C. § 371 of PCT Application No. PCT/GB2019/051881, filed Jul. 3, 2019, which claims the benefit of Great Britain Application No. 1810911.6, filed Jul. 3, 2018. The entire contents of each of PCT Application No. PCT/GB2019/051881 and Great Britain Application No. 1810911.6 are incorporated herein by reference in their entireties.

FIELD OF THE INVENTION

The present invention relates to casino security systems, in particular to security systems for preventing theft from casino apparatuses.

BACKGROUND TO THE INVENTION

Casinos derive a great deal of revenue from gaming machines such as mechanical and video slots and table games such as poker and twenty-one. Three important factors to casino operators related to providing these games are: 1) minimizing operating costs, 2) responding to the desires of players, their customers, which are constantly shifting and 3) providing a secure and honest gaming experience. Minimizing operating costs involves factors, such as minimizing the labour and maintenance costs associated with providing a game at a gaming machine or at a table. Responding to the desires of players involves factors, such as changing games on a gaming machine, providing new types of games, rearranging a layout and distribution of gaming machines and/or table games on a casino floor and providing player incentives via casino-sponsored loyalty programs. Finally, providing a secure and honest gaming experience involves such factors as providing tamper-proof gaming machines and table games, and secure gaming platforms that meet regulatory requirements and providing security monitoring systems that help deter theft and other potential crimes such as tampering with a casino apparatus in order to control an outcome.

The factors described above are reflected in the history of technology development associated with the gaming industry. For example, casino monitoring systems were introduced to minimize costs associated with gathering accounting data from gaming machines. Until the advent of casino monitoring systems the accounting of coin-in, coin-out, and other data associated with each machine was done manually.

The introduction of casino monitoring systems provided the means for a casino operator to gather this data electronically using a communication network. This reduced the cost for the casino by reducing the expense of the manual data gathering associated with each gaming machine.

To provide a secure gaming experience, gaming machines and table games include security measures, such as locked cabinets for securing resources that may be targets of theft or tampering, such as deposited money or gaming software. Further, external security systems, such as camera systems are provided for monitoring employee and player behaviour including detecting illegal actions. To ensure an honest gaming experience, gaming machines tend to be highly regulated. For instance, gaming software and hardware associated with determining an outcome of game and dispensing money from a gaming machine can undergo a regulatory approval process that takes up to a year before the gaming software or hardware can be utilized in the field, such as on a casino floor. Further, after deployment, regulator approved gaming software and hardware are secured and monitored in a gaming device such that changes or modifications are readily detectable.

The technological advances, described above, each viewed in isolation, have contributed to minimizing operating costs, responding to the desires of players and providing a secure and honest gaming experience. However, these advances viewed as a whole have also created problems. Currently, gaming machines on a casino floor can be connected to many different and separately maintained networks. For instance, a single gaming machine on a casino floor, which may include thousands of gaming machines, can be connected via wired connections to separate WAP, player tracking, link progressive and TITO networks. Maintaining many different networks and their associated infrastructure can be quite costly, and real-time identification of theft or corruption is increasingly unlikely.

Monitoring currently involves the use of casino security cameras. Current forms of monitoring tend to require security cameras to be permanently focused on, for instance, a gaming machine, gaming table or chipping machine, and is generally reliant upon a surveillance team to be continually monitoring each machine to identify, characterise and record activity on said machines. This method is flawed, and is open to human error, as it generally relies upon said activity being witnesses at the correct moment. Such activity can easily be missed in current methods, should the surveillance team be busy dealing with another incident. The activity could be viewed retrospectively, but may rely upon the activity being detailed and/or captured by personnel on the gaming floor, to provide to the surveillance team with date and time stamps in order to practicably trawl through recorded footage to identify the activity. Not only does this generally present a time- and resource-intensive process, but it can also mean that the activity is not able to be reviewed for a lengthy time after the activity has taken place, which poses a number of concerns for a security system.

Some machines are arranged to emit a high-pitched alarm sound when opened without authorisation. This does not, however, prevent tampering with a machine by authorised personnel.

Machines may log, internally, if the machine was opened. This log will typically capture the date and time, however, the log does not generally contain detail of the user, or detail of the activity performed while open.

Other disadvantages of current machines include the tendency for maintenance to be initiated unnecessarily, which can lead to unnecessary down-time of the machine.

It is therefore desirable to provide a secure apparatus for use in a casino, overcoming the problems posed by current technology.

SUMMARY OF THE INVENTION

In accordance with a first aspect of the present invention, there is provided a secure casino apparatus comprising,

- a casing and a cavity within the casing, the casing comprising an access member arranged to provide access to said cavity;
- a sensor arranged to detect said access to the cavity and provide an access signal;
- an image capture apparatus arranged to provide image data of the cavity when the image capture apparatus is activated;
- a memory arranged to store the image data; and
- a processor arranged to process the image data and the access signal; wherein the processor is further arranged to activate the image capture apparatus for an activation period when an access signal is provided by the sensor.

In preferable embodiments, the access member is a door. In said preferable embodiments, the access member is arranged to be opened, and thereby providing access to the cavity. In further preferable embodiments, the access member comprises a locking mechanism arranged to be actuated by an unlocking member. Preferably the unlocking member is one selected from: a key; a wireless fob; a code; a sequence of digits.

Access to the cavity, in the context of the present invention, will be understood by the skilled addressee to mean access to the cavity gained by an individual. In the context of the present invention, the individual may optionally be an individual who is authorised to access the cavity. The individual may be an individual who is not authorised to access the cavity. Access to the cavity may be obtained by actuating the access member. In certain embodiments, access to the cavity may be obtained using a method that does not involve actuating the access member.

Image data of the cavity, in the context of the present invention, will be understood by the skilled addressee to mean image data comprising an image, the image providing a view of at least a portion of the cavity. In preferable embodiments, the image data comprises an image providing a view of the cavity and activity performed within said cavity. In preferable embodiments, the activity may comprise activity performed by the secure casino apparatus and/or activity of an individual having accessed the cavity.

Preferably the image capture apparatus is located substantially inside the cavity.

Preferably the access comprises a duration, and wherein the sensor is arranged to provide the access signal throughout the duration of said access. More preferably the processor is arranged to activate the image capture apparatus for the duration of said access.

Preferably the access comprises a duration, and wherein the sensor is arranged to provide the access signal at intervals of predetermined length throughout the duration of said access. More preferably the activation period is not shorter than the predetermined length.

Preferably the processor is arranged to activate the image capture apparatus for a predetermined buffer period after the duration of said access.

In accordance with preferable embodiments, the secure casino apparatus further comprises an image transmission member arranged to transmit the image data. Preferably the image transmission member is arranged to transmit the image data by live-streaming said image data. Preferably the image transmission member is arranged to transmit the image data to a remote device, the remote device comprising one selected from the range: a display screen located on the secure casino apparatus; a server; a mobile device; a computer.

Preferably the secure casino apparatus further comprises a signal transmission member arranged to transmit the access signal.

Preferably the access detected by the sensor comprises a mode, the mode being one selected from the range: authorised access, or unauthorised access. Preferably the processor is arranged to determine the mode from the access signal.

Preferably the secure casino apparatus further comprises an alerting member arranged to provide an alert when the alerting member is activated. Preferably the alert comprises at least one selected from the range: an electronic mail; a text message; a dashboard alert; an alarm; a software feature; a video message; a screen animation; an audible alert; a supersonic audio alert.

In preferable embodiments wherein the access detected by the sensor comprises a mode, the mode being one selected from the range: authorised access, or unauthorised access, and wherein the processor is arranged to determine the mode from the access signal, preferably the processor is further arranged to activate the alerting member when an access signal having a unauthorised access mode is provided by the sensor.

Preferably the secure casino apparatus is one selected from the range: a gaming token sorting apparatus; a chipper; a gaming terminal; an electronic gaming machine; a gaming token transport device; a currency transport device; a dice spinner; a game ball spinner; a dice shaker.

In the context of the present invention, the term "gaming" will be understood by the skilled addressee to mean "gambling".

Preferably the cavity is arranged to transport, store and/or sort one selected from the range: physical currency; gaming tokens; a data storage device; identification data.

In embodiments wherein the secure casino apparatus is a gaming token sorting apparatus, which may optionally be a chip sorting apparatus, the cavity is preferably a cavity within the gaming token apparatus wherein gaming tokens are transported, stored and/or sorted. In embodiments wherein the secure casino apparatus is a gaming terminal or an electronic gaming machine, the cavity is preferably a cavity wherein gaming tokens and/or currency are transported, stored and/or sorted.

Preferably the processor is further arranged to perform pattern recognition on the image data, and is further arranged to transform an access signal having a unauthorised access mode into an access signal having an authorised access mode; wherein the processor is arranged to carry out the transformation upon recognition of a known pattern.

Preferably the secure casino apparatus further comprises an identification member arranged to identify an individual.

In accordance with a second aspect of the present invention, there is provided a casino apparatus security system, the security system comprising:

a secure casino apparatus comprising:

a casing and a cavity within the casing, the casing comprising an access member arranged to provide access to said cavity;

a sensor arranged to detect said access to the cavity and provide an access signal; an image capture apparatus arranged to provide image data of the cavity when the image capture apparatus is activated;

a memory arranged to store the image data;

a processor arranged to process the image data and the access signal; and an image transmission member arranged to transmit the image data; wherein the processor is further arranged to activate the image capture apparatus for an activation period when an access signal is provided by the sensor;

the security system further comprising:

a monitoring system comprising a remote device arranged to receive the image data from the image transmission member.

Preferably the secure casino apparatus is one according to the first aspect of the present invention. Preferably the remote device comprises one selected from the range: a display screen located on the secure casino apparatus; a server; a mobile device; a computer; media player; data storage device.

In accordance with a third aspect of the present invention, there is provided a method of monitoring access to a secure casino apparatus, the method comprising the steps of:

i. detecting an access to a cavity comprised within a secure casino apparatus;

ii. activating an image capture apparatus;

iii. storing image data from said image capture apparatus in a memory.

Preferably, method is performed using a security system in accordance with the second aspect of the present invention.

Preferably the secure casino apparatus is one in accordance with the first aspect of the present invention.

Preferably the method further comprises the step of:

iv. transmitting said image data.

Preferably the method further comprises the step of:

v. providing an alert.

DETAILED DESCRIPTION

Specific embodiments will now be described by way of example only, and with reference to the accompanying drawings, in which.

Figure 1A:
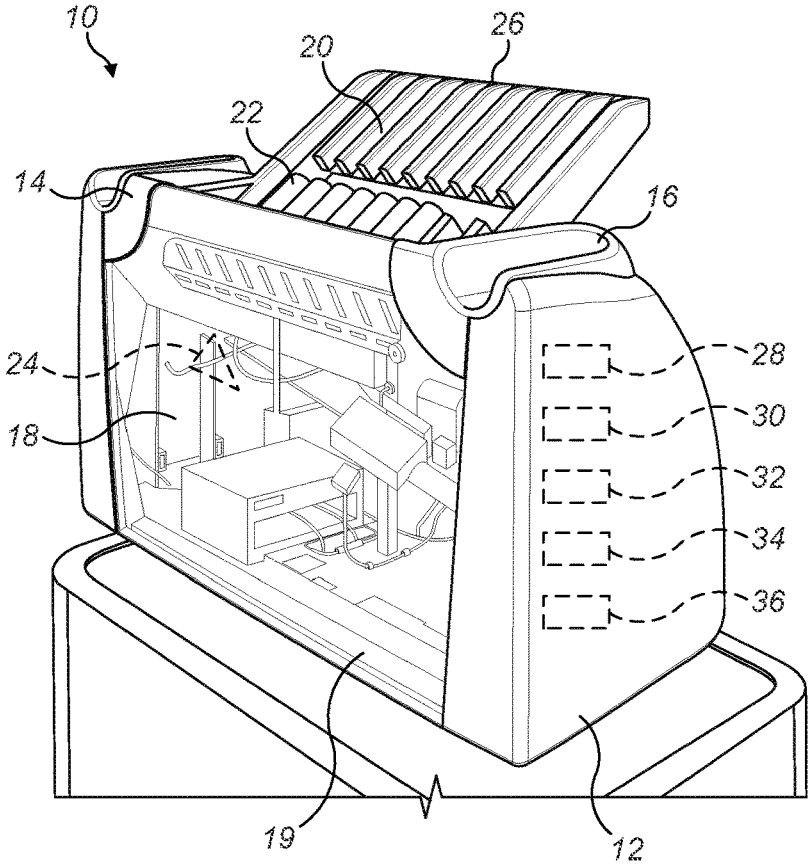
FIG. 1A shows an example embodiment of a secure casino apparatus in accordance with a first aspect of the present invention.

An example embodiment of a secure casino apparatus 10 according to the first aspect of the present invention is shown in FIG. 1A. The secure casino apparatus 10 is a token sorting apparatus arranged to supplement a casino table game such as roulette, which uses gaming tokens, such as gaming chips. The secure casino apparatus 10 comprises a substantially cuboidal base 12 having an upper surface 14 supporting an entry aperture 16. The entry aperture 16 provides a route of entry into an internal cavity 18 of the base 12. The cavity 18 is bounded within the base 12 by walls and a door 19 providing access to the cavity 18. The cavity 18 accommodates a conveyor (not shown), arranged to urge gaming tokens accepted by the entry aperture 16 to a sorting mechanism (not shown) arranged to sort the gaming tokens according to the currency value of said gaming tokens. The sorting mechanism comprises a plurality of vertically inclined channels 20 arranged to accommodate stacks of sorted gaming tokens 22. A camera 24 is positioned in an upper corner of the cavity 18, and oriented to view and capture image data of the interior of the cavity 18. At the apex of the inclined channels 20 is positioned a display screen 26, having a touch-sensitive screen, the screen being declined from the apex of the inclined channels 20 and facing away from the token sorting apparatus 10.

The token sorting apparatus 10 further comprises a plurality of sensors (not shown) arranged to detect operation data relating to the use of the apparatus, including an access signal provided when access to the cavity 18 is detected by way of the door 19.

Located within the base 12 is a processor 28 arranged to accept and process the image data from the camera 24 and the data from the sensors, comprising the access signal. The token sorting apparatus 10 further comprises a memory 30 arranged to store the image data from the camera 24 and the operation data obtained by the sensors. The token sorting apparatus 10 further comprises an image transmission member 32, a signal transmission member 34 and an alerting member 36 comprised within the base 12. The processor 28, memory 30, camera 24, display screen 26, sensors (not shown), the image transmission member 32, the signal transmission member 34 and the alerting member 36 are all arranged to be in digital communication with one another.

The sorting mechanism elements of the sorting apparatus can be as described in, for example, GB2333632A.

Figure 1B:
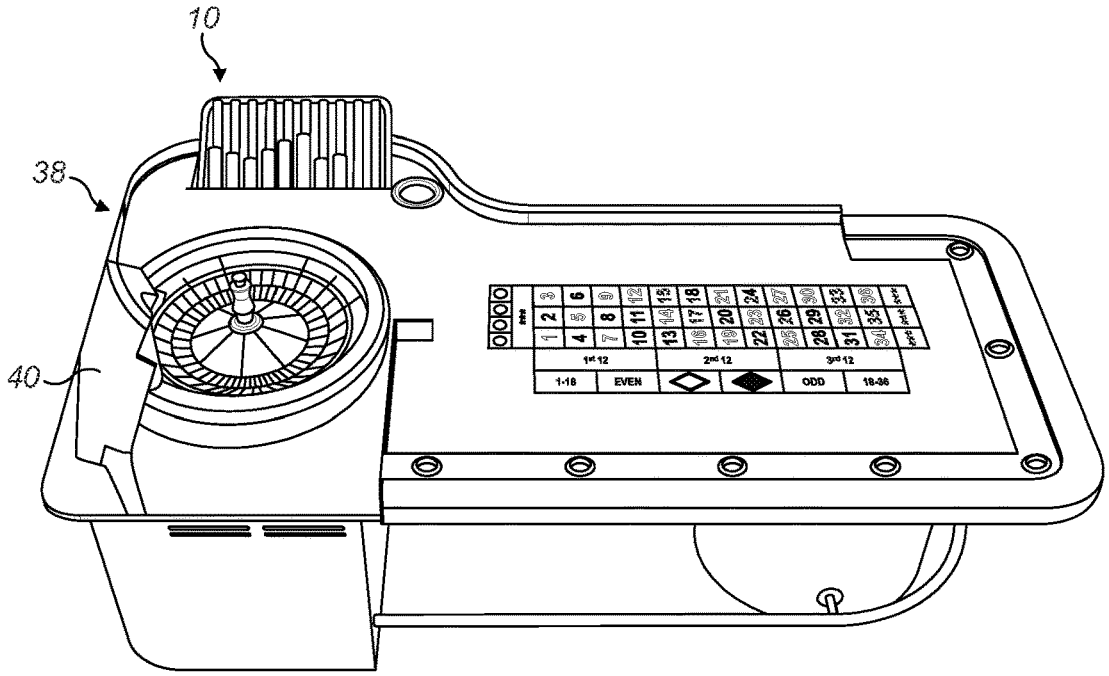
FIG. 1B shows the example embodiment of a secure casino apparatus from FIG. 1A incorporated into a roulette gaming table.

FIG. 1B shows a roulette gaming table 38 having the secure casino apparatus 10 incorporated therein.

In use, the user of the token sorting apparatus 10 according to the embodiment shown is a croupier attending to the gaming table 38. The token sorting apparatus 10 is arranged to receive information from an automated roulette wheel 40 incorporated into the gaming table 38, relating to the stage of the roulette game, and various other operation data associated with the use of the roulette wheel 40. In use, the token sorting apparatus is used to aid in the operation of a table game like roulette. In a game of roulette, patrons wager gaming tokens, which are collected by a croupier into a slot within the upper surface of the gaming table, leading into the cavity of the token sorting apparatus. Following sorting, the sorted gaming tokens are returned to the croupier in stacks for distribution to winners in the roulette game.

In use, access to the token sorting apparatus 10 using the door panel 19, which may be for repair or maintenance, is detected by the sensor and as a result the processor activates the camera 24 for an activation period. In the embodiment shown, the sensor is arranged to detect an access to the cavity 18 and provide an access signal at predetermined intervals, in the embodiment shown, the predetermined interval is 10 seconds. The activation period in the embodiment shown is 30 seconds. As such, in the embodiment shown, if access to the cavity 18 is no longer detected by the sensor, the camera 24 is arranged to continue recording for a period after said access has ceased.

In the embodiment shown, the image transmission member 32 is arranged to live-stream the image data to a remote device when the image data is received by the processor 28 following activation of the camera 24 by the processor 28.

In the embodiment shown, the alerting member 36 is arranged to transmit an email alert and/or a dashboard notification to a remote device when an access signal is received by the processor 28 from the sensor. The dashboard notification will be understood by the skilled reader to mean a notification appearing on a display screen.

In the embodiment shown, the remote device discussed in relation to the image transmission member 32 and the alerting member 36 is a computer operated by one or more surveillance personnel tasked with remote monitoring of casino apparatuses. The computer is in communication with the image transmission member 32 and the alerting member 36 over a network. When connected to the network, the image transmission member 32 and the alerting member 36 are arranged to transmit a dashboard alert, and email alert and/or another form of text-based alert. In the embodiment shown, recording of activity and image data, which may be transmitted to the computer, occurs on the secure casino apparatus. Embodiments of the present invention will be appreciated wherein the secure casino apparatus does not transmit data or notifications to a remote device.

In use, access to the token sorting apparatus 10 cavity 18 can be easily monitored since an alert is provided to a surveillance team when access is detected. This means that continuous visual surveillance of what may be a great number of casino apparatuses by the surveillance team is not required, and thus reduces the likelihood of human omission.

In the embodiment 10 shown, the door 19 comprises a lock which may be opened, or actuated, using a dedicated Dallas key. A Dallas key provides low-speed data, signalling, and power over a single conductor, and can be incorporated into a key fob for use in, for example, actuating locking mechanisms comprised with door panels of token sorting apparatuses as discussed in relation to the presently described embodiment.

In a typical casino environment, only a select few personnel, whose duties require relevant access to the cavity 18 of the token sorting apparatus 10, are authorised to carry the correct Dallas key designed to actuate the lock of the door panel 19. Use of the correct Dallas key to actuate the door panel is an example of an authorised access to the cavity 18 of the token sorting apparatus 10 of the embodiment shown, and upon detection by the sensor, would cause the sensor to provide an access signal to the processor 28. In the embodiment shown, the sensor includes a first sensor for detecting the use of a Dallas key (i.e. detecting a consensual actuation of the access member), and a second sensor for detecting the opening of the door 19. An example of a first sensor may include: (examples of sensors which may be used for detecting Dallas keys). An example of a second sensor may include: a motion sensor; (examples of sensors which may be used for detecting opening of the door). In the embodiment shown, the processor 28 is arranged to process the access signal received from the sensor, and arranged to determine the mode of access, whether this be an authorised access or an unauthorised access.

Any other means of gaining access to the cavity of the token sorting apparatus of the embodiment shown, without use of said dedicated Dallas key described above, are examples of unauthorised access to the cavity 18. Examples of such unauthorised access may be through tampering with the locking mechanism comprised with the door panel 19. In the embodiment shown, an access signal sent by the sensor, and having an unauthorised mode, is determined by the processor 28 if the second sensor detects an opening of the door panel 19 while the first sensor does not detect the presence of a Dallas key.

Figure 2:
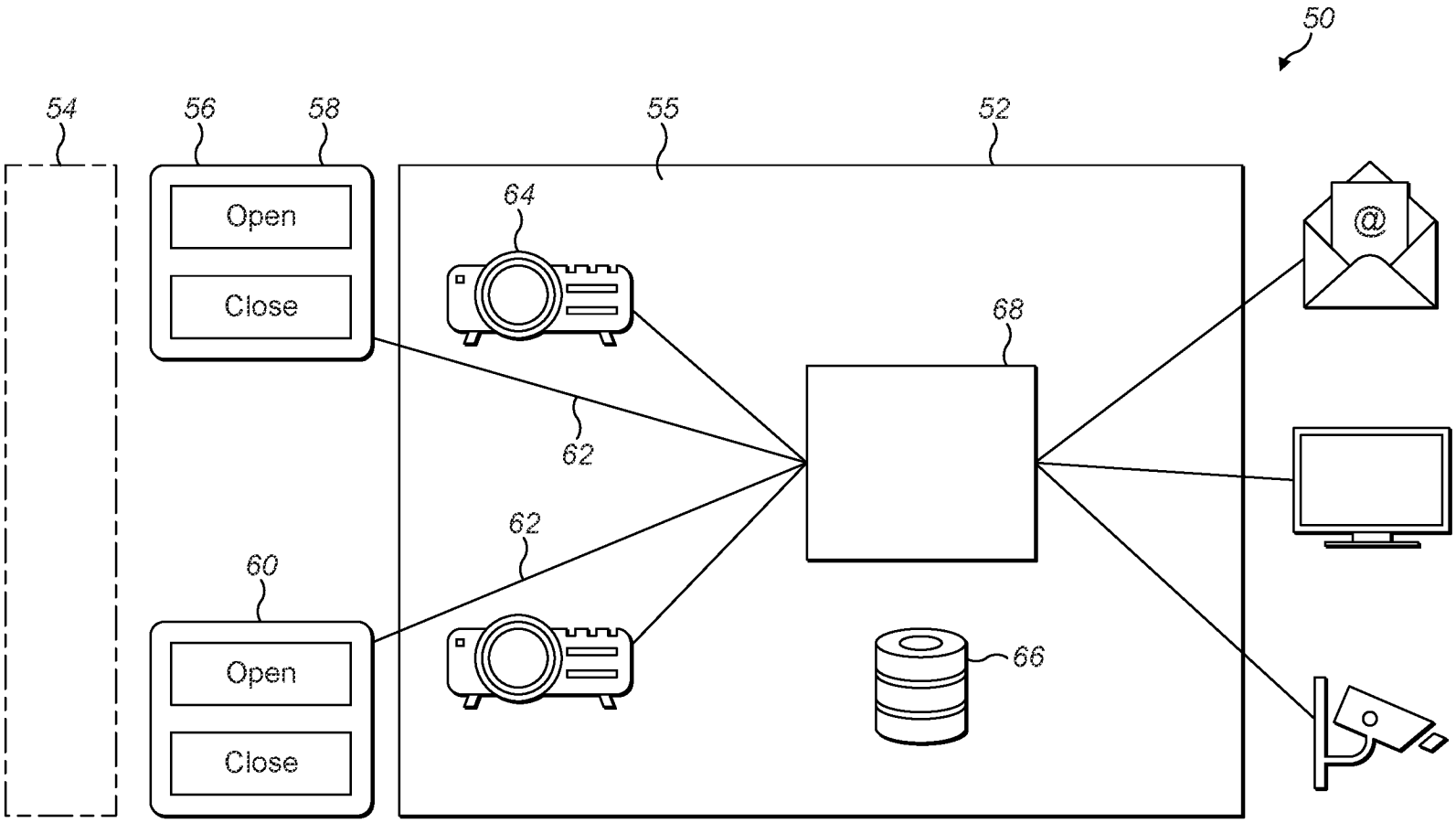
FIG. 2 shows a schematic diagram of a secure casino apparatus in accordance with a first aspect of the present invention.

A schematic diagram of an example embodiment of a casino apparatus security system 50 in accordance with the second aspect of the present invention is shown in FIG. 2, the security system 50 comprising: a casino apparatus 52 comprising a cavity 55 and an access member 54 arranged to provide access to said cavity upon actuation of said access member 54; said access having a mode 56, the mode 56 comprising one selected from: authorised access 58, and unauthorised access 59; a sensor 60 arranged to detect the access, and further arranged to provide a signal 62; an image capture apparatus 64 arranged to provide image data upon activation of said image capture apparatus 64; a memory 66 arranged to store the image data; a processor 68 arranged to process the image data and the signal 62; wherein the processor 68 is arranged to activate the image capture apparatus 64 for an activation period when an access signal 62 is provided by the sensor 60.

In the embodiment 50 shown, the casino apparatus 52 takes the form of a token sorting apparatus, a chipper, as described in relation to FIG. 1A.

Figure 3:
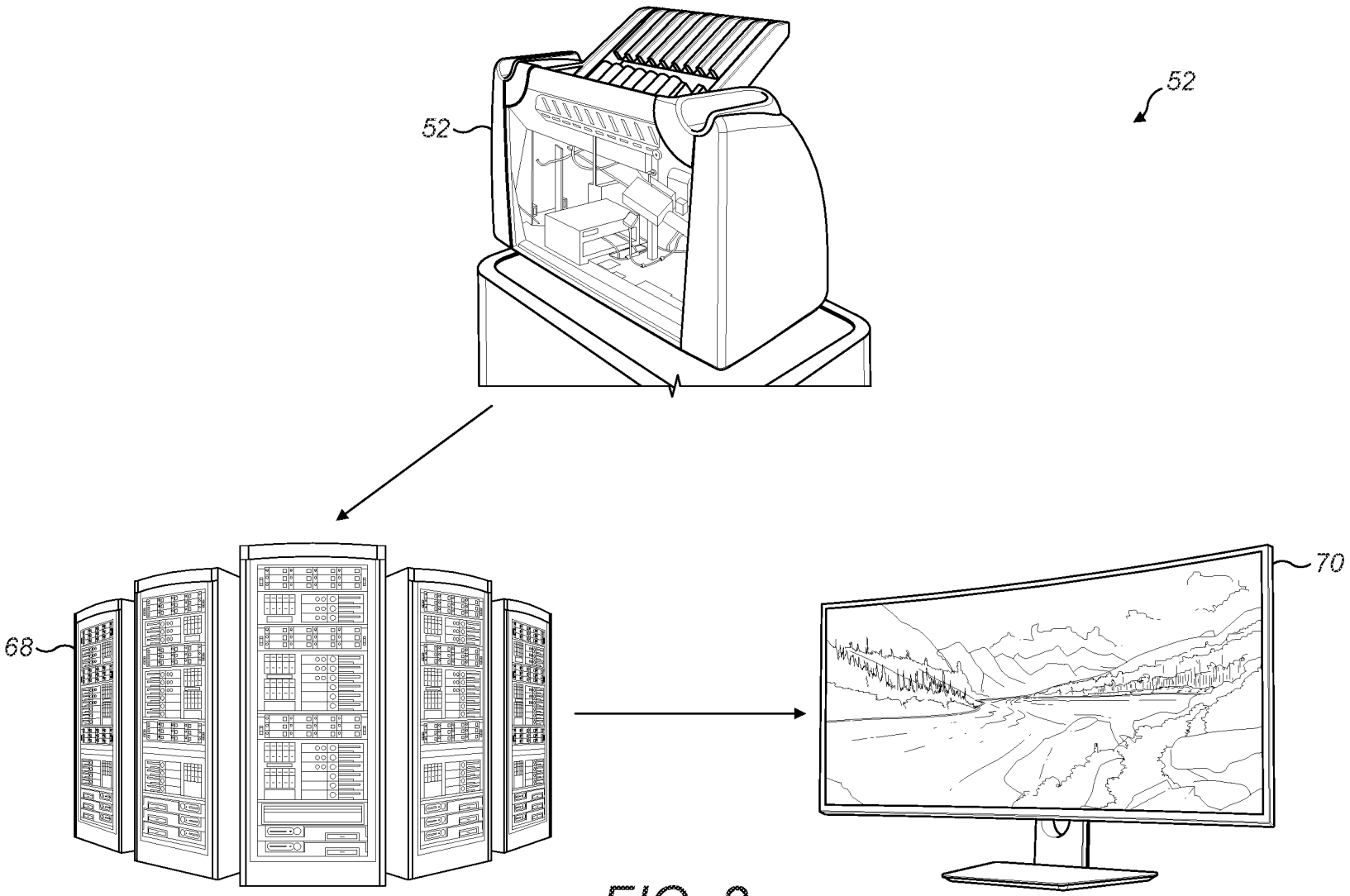
FIG. 3 shows an example embodiment of a casino apparatus security system in accordance with a second aspect of the present invention.

The security system of the embodiment shown 50 is further detailed in FIG. 3, which comprises a secure casino apparatus 52 substantially as previously described in relation to FIG. 1A, having an image transmission member (not shown), a signal transmission member (not shown) and an alerting member (not shown), all arranged to communicate with the a surveillance team computer 70 by way of a server 68.

Figure 4:
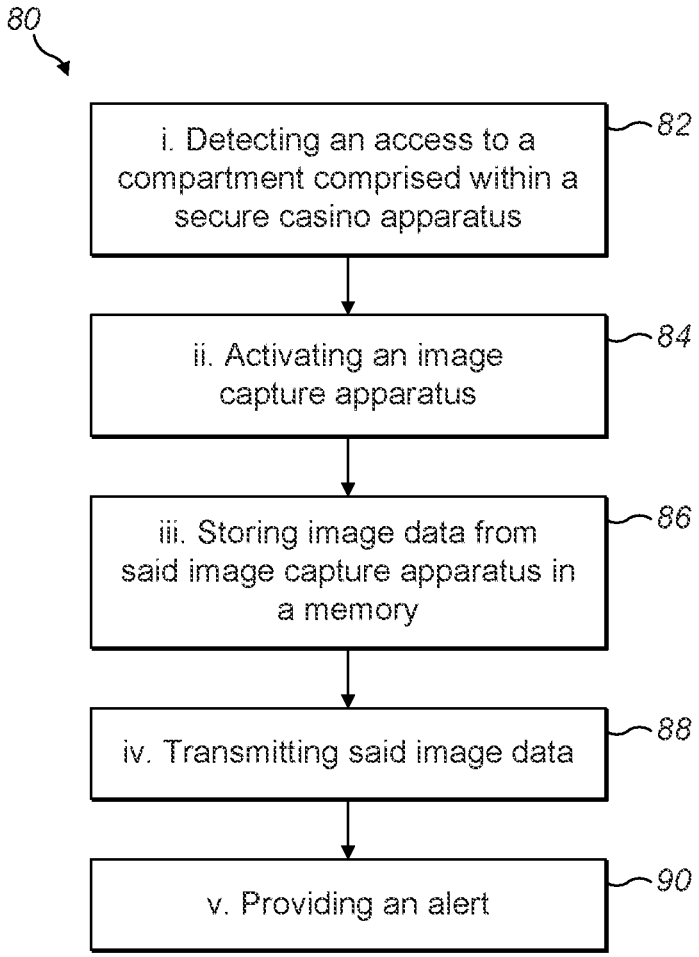
FIG. 4 shows an example embodiment of a method in accordance with a third aspect of the present invention.

FIG. 4 shows an example embodiment of a method 80 according to the third aspect of the present invention, the method comprising the steps of:

i. detecting an access to a cavity comprised within a secure casino apparatus 82;
ii. activating an image capture apparatus 84;
iii. storing image data from said image capture apparatus in a memory 86;
v. transmitting said image data 88; and
vi. providing an alert 90.

It will be appreciated that the above described embodiments are given by way of example only and that various modifications thereto may be made without departing from the scope of the invention as defined in the appended claims.

The invention claimed is:

1. A secure casino apparatus, comprising:
a casing and a cavity within the casing, the casing further comprising an access member arranged to provide access to the cavity;
a sensor arranged to detect the access to the cavity and provide an access signal;
an image capture apparatus arranged to provide image data of the cavity when the image capture apparatus is activated;
a memory arranged to store the image data; and
a processor arranged to:
process the image data and the access signal;
activate the image capture apparatus for an activation period when the access signal is provided by the sensor;
determine that the access signal comprises a first access signal having an unauthorised access mode;
perform pattern recognition on the image data; and
upon recognition of a known pattern, transform the first access signal having the unauthorised access mode into a second access signal having an authorised access mode.

2. The secure casino apparatus of claim 1, wherein the image capture apparatus is located substantially inside the cavity.

3. The secure casino apparatus of claim 2, wherein the processor is arranged to activate the image capture apparatus for a predetermined buffer period after the duration of the access.

4. The secure casino apparatus of claim 1, wherein the access comprises a duration, and wherein the sensor is arranged to provide the access signal throughout the duration of the access.

5. The secure casino apparatus of claim 4, wherein the processor is arranged to activate the image capture apparatus for the duration of the access.

6. The secure casino apparatus of claim 1, wherein the access comprises a duration, and wherein the sensor is arranged to provide the access signal at intervals of predetermined length throughout the duration of the access.

7. The secure casino apparatus of claim 6, wherein the activation period is not shorter than the predetermined length.

8. The secure casino apparatus of claim 1, wherein the secure casino apparatus further comprises an image transmission member arranged to transmit the image data.

9. The secure casino apparatus of claim 8, wherein the image transmission member is arranged to transmit the image data by live-streaming the image data.

10. The secure casino apparatus of claim 8, wherein the image transmission member is arranged to transmit the image data to a remote device, the remote device comprising one of a display screen located on the secure casino apparatus, a server, a mobile device, or a computer.

11. The secure casino apparatus of claim 1 wherein the secure casino apparatus further comprises a signal transmission member arranged to transmit the access signal.

12. The secure casino apparatus of claim 1, wherein the access detected by the sensor comprises a mode, the mode being one of an authorised access or an unauthorised access.

13. The secure casino apparatus of claim 12, wherein the processor is arranged to determine the mode from the access signal.

14. The secure casino apparatus of claim 1, wherein the secure casino apparatus further comprises an alerting member arranged to provide an alert when the alerting member is activated.

15. The secure casino apparatus of claim 14, wherein the alert comprises at least one of an electronic mail, a text message, a dashboard alert, an alarm, a software feature, a video message, a screen animation, an audible alert, or a supersonic audio alert.

16. The secure casino apparatus of claim 14, wherein the processor is further arranged to activate the alerting member when the access signal having the unauthorised access mode is provided by the sensor.

17. The secure casino apparatus of claim 1, wherein the secure casino apparatus is one of a gaming token sorting apparatus, a chipper, a gaming terminal, an electronic gaming machine, a gaming token transport device, a currency transport device, a dice spinner, a game ball spinner, or a dice shaker.

18. The secure casino apparatus of claim 1, wherein the cavity is arranged to at least one of transport, store or sort one of physical currency, gaming tokens, a data storage device, or identification data.

19. A casino apparatus security system, comprising:

a secure casino apparatus comprising:

a casing and a cavity within the casing, the casing comprising an access member arranged to provide access to the cavity;

a sensor arranged to detect the access to the cavity and provide an access signal;

an image capture apparatus arranged to provide image data of the cavity when the image capture apparatus is activated;

a memory arranged to store the image data;

a processor arranged to process the image data and the access signal; and an image transmission member arranged to transmit the image data, wherein the processor is further arranged to:

activate the image capture apparatus for an activation period when an access signal is provided by the sensor, determine that the access signal comprises a first access signal having an unauthorised access mode;

perform pattern recognition on the image data; and upon recognition of a known pattern, transform the first access signal having the unauthorised access mode into a second access signal having an authorised access mode, and wherein the casino apparatus security system further comprises a monitoring system comprising a remote device arranged to receive the image data from the image transmission member.

20. A method of monitoring access to a secure casino apparatus, the method comprising:

detecting, by a sensor, an access to a cavity comprised within the secure casino apparatus;

activating an image capture apparatus for an activation period in response to receiving an access signal from the sensor in response to detecting the access to the cavity;

storing image data from the image capture apparatus in a memory;

determining, by a processor, that the access signal comprises a first access signal having an unauthorised access mode;

performing, by the processor, pattern recognition on the image data; and upon recognition of a known pattern, transforming, by the processor, the first access signal having the unauthorised access mode into a second access signal having an authorised access mode.

21. The method of claim 20, the method being performed using a casino apparatus security system comprising: the secure casino apparatus comprising:

a casing, the cavity being within the casing, the casing comprising an access member arranged to provide access to the cavity;

the sensor arranged to detect the access to the cavity;

the image capture apparatus arranged to provide image data of the cavity when the image capture apparatus is activated;

the memory arranged to store the image data;

the processor arranged to process the image data and the access signal; and an image transmission member arranged to transmit the image data, and wherein the casino apparatus security system further comprises a monitoring system comprising a remote device arranged to receive the image data from the image transmission member.

22. The method of claim 20, wherein the secure casino apparatus comprises:

a casing, the cavity being within the casing, the casing further comprising an access member arranged to provide access to the cavity;

the sensor arranged to detect the access to the cavity and provide the access signal;

the image capture apparatus arranged to provide image data of the cavity when the image capture apparatus is activated;

the memory arranged to store the image data; and the processor arranged to process the image data and the access signal.

23. The method of claim 20, wherein the method further comprises:

transmitting the image data.

24. The method of claim 20, wherein the method further comprises:

providing an alert.

* * * * *